United States Patent [19]

Hickey et al.

[11] Patent Number: 5,040,558

[45] Date of Patent: Aug. 20, 1991

[54] LOW THERMAL STRESS STEAM DISTRIBUTION MANIFOLD

[75] Inventors: Patrick J. Hickey; N. David Ballard, both of Bakersfield, Calif.

[73] Assignee: Mobil Oil Corporation, Fairfax, Va.

[21] Appl. No.: 606,226

[22] Filed: Oct. 31, 1990

[51] Int. Cl.[5] ..... E03B 1/00

[52] U.S. Cl. ..... 137/1; 137/561 A

[58] Field of Search ..... 137/561 A, 1, 861, 872; 166/303

[56] References Cited

U.S. PATENT DOCUMENTS

| | | | |
|---|---|---|---|
| 2,144,898 | 4/1938 | Shrode | 62/127 |
| 3,795,259 | 3/1974 | Brandin et al. | 137/561 A |
| 3,899,000 | 8/1975 | Ohlswager et al. | 137/561 A |
| 4,085,776 | 4/1978 | Derrick, Jr. | 137/561 A |
| 4,269,211 | 5/1981 | Howard et al. | 137/2 |
| 4,505,297 | 3/1985 | Leech, III et al. | 137/561 A |
| 4,528,919 | 7/1985 | Harbolt et al. | 111/7 |
| 4,574,837 | 3/1986 | Aggour et al. | 137/561 A |
| 4,662,391 | 5/1987 | Tolley | 137/561 A |
| 4,800,921 | 1/1989 | Greebe | 137/561 A |

FOREIGN PATENT DOCUMENTS

| | | | |
|---|---|---|---|
| 158176 | 9/1903 | Fed. Rep. of Germany | 137/561 A |
| 920989 | 4/1954 | Fed. Rep. of Germany | 137/561 A |

*Primary Examiner*—A. Michael Chambers
*Attorney, Agent, or Firm*—A. J. McKillop; C. J. Speciale; M. J. Mlotkowski

[57] ABSTRACT

A manifold for dividing a single, two-phase mixed stream of vapor and liquid into a plurality of individual streams of substantially uniform quality. The manifold includes: a flow disperser having an inlet port for receiving the vapor-liquid mixture and at least two outlet ports; at least two hollow runners, each runner having a first end in fluid communication with one of the outlet ports of the flow disperser and a second end; a substantially toroidal manifold shell having at least two fluid receiver ports in fluid communication with each of the second ends of the runners, the manifold shell defining a manifold chamber; and a plurality of distribution ports spaced about the toroidal manifold shell, the distribution ports located on the toroidal manifold shell in a substantially coplanar relationship with the fluid receiver ports, each distribution port in fluid communication with the manifold chamber of the toroidal manifold shell; wherein the vapor-liquid mixture emanating from each the distribution port of the manifold is of substantially uniform quality. A method for uniformly distributing a vapor-liquid mixture is also provided.

20 Claims, 5 Drawing Sheets

LOW THERMAL STRESS STEAM DISTRIBUTION MANIFOLD

FIELD OF THE INVENTION

The present invention relates to an apparatus and method for dividing a single, two-phase mixed stream of vapor and liquid into a plurality of individual streams of uniform vapor-to-liquid ratio. More particularly, the present invention employs a manifold of toroidal configuration which receives a single two-phase mixed stream from a supply line and divides it into a plurality of streams for distribution therefrom.

BACKGROUND OF THE INVENTION

There are many oil-bearing subterranean formations from which the resident oil cannot be recovered in economic quantities by primary recovery techniques. In these formations, secondary recovery techniques must be employed to enable the oil to be produced in economic quantities. One of the secondary recovery techniques which has been found to be well-suited for use in these formations is known generally as steam stimulation. In this technique, steam is injected into the formation for a period of time until the formation is heated sufficiently well so that the viscosity of the oil contained therein is reduced to a degree that it may be readily produced.

Fundamentally, water can exist as either a gas or a liquid under saturated conditions. Wet steam can contain both gas and liquid components, known to those skilled in the art as two-phase flow. A common method of expressing the quantities of each phase, known as quality, is the ratio of the mass flow rate of the gas phase to the total mass flow rate, expressed as a number less than one or as a percentage. Another expression of steam quality is the use of the ratio of vapor to liquid.

In thermally enhanced oil recovery projects it is common to employ a high quality, two-phase steam which may be prepared for convenience at a central steam generating facility. As is well known to those skilled in the art, the practice of utilizing a high quality, two-phase steam is necessitated by the use of low quality, brackish waters having at least a moderate level of dissolved solids. To prevent deposition of salts on the surface of the steam generator tubes, it is necessary to retain part of the flow in a liquid state in order to maintain the solids and other impurities in solution. As can be appreciated, should the steam so generated be required to be distributed to a plurality of injection wells from a single generator output line, it is essential that this plurality of individual flows be maintained at a consistent and desirable vapor-to-liquid ratio. The problem which exists in the distribution of a two-phase mixed stream of vapor and liquid to a plurality of locations is that without special provisions, the vapor and liquid components will not divide into flows of uniform vapor-to-liquid ratio.

Several attempts have been made to provide an apparatus for distributing a two-phase mixed stream of vapor and liquid. For example, U.S. Pat. No. 3,899,000 provides a closed vessel structure for the separation of a two-phase vapor-liquid mixture into two or more individual flows. The vessel disclosed is mounted vertically and provided with a top inlet and two or more bottom outlets. A flat, horizontal baffle is used to divert the inlet flow from the open ends of the outlets. The axis of the inlet and the axis of the outlets are substantially parallel so that the flow of the fluid is axially through the elongated vessel. It is taught that the vapor-to-liquid ratio is maintained by using the outlets as standpipes and the vessel as a reservoir. Once sufficient liquid collects in the bottom of the vessel, it can overflow the side outlets in the standpipes and liquid will be added to the vapor flowing out of the outlets.

U.S. Pat. No. 4,269,211 discloses a method for equalizing the steam quality in a plurality of branch lines of a high pressure steam pipeline. Also disclosed is a steam manifold distribution system which includes a mechanism for retracting a perforated baffle plate into a pressure equalizer chamber for removal, repair or replacement of the baffle plate. The pressure equalizer chamber of U.S. Pat. No. 4,269,211 may be positioned on and fixedly attached to a tee joint in the field in any position between and coaxial with one of the branch lines of the tee joint and perpendicular thereto.

U.S. Pat. No. 4,505,297 discloses an apparatus for dividing a single stream vapor-liquid mixture into a plurality of individual streams while maintaining a similar vapor-to-liquid ratio in the individual streams. The apparatus taught comprises a closed vessel having a central inlet in the top for the inlet feedstream and a plurality of outlets in the side of the vessel for the individual streams. A frustrum-shaped diverting member is mounted in the center of the vessel to divert the flow of the single feedstream into the individual streams. A bottom drain is disclosed for use in removing any liquid that is separated from the vapor-liquid mixture.

U.S. Pat. No. 4,800,921 teaches the utilization of a gravity influenced liquid distribution system in an annular flow regime within a substantially horizontal header which receives a liquid vapor mixture from a supply line and divides that single stream into a plurality of streams for distribution through a branchline to a nearby site. The header employed is substantially horizontal, with each branchline connected to the periphery of the header further downstream and relatively lower on the periphery of the header than the preceding branchline.

Application Ser. No. 526,475, filed on May 21, 1990, the inventor of which is a co-inventor of the present invention, discloses a steam manifold and distribution system capable of uniformly distributing steam throughout a field through a plurality of steam distribution lines. The manifold includes a flow disperser, at least two hollow runners in fluid communication with the outlets of the flow disperser, a substantially toroidal manifold shell in fluid communication with the runners, the manifold shell defining a manifold chamber, and a plurality of distribution ports spaced about the substantially toroidal manifold shell, each distribution port in fluid communication with the manifold chamber. As taught therein, the hollow runners direct the two-phase mixed stream of vapor and liquid into the manifold chamber perpendicular to the plurality of distribution ports spaced about the substantially toroidal manifold shell. Application Ser. No. 526,475, is hereby incorporated by reference for all that it discloses.

It has now been found that although the manifold disclosed in Application Ser. No. 526,475 provides a design which aids in the uniform distribution of a two-phase mixed stream of vapor and liquid, thermal stresses encountered within the manifold may be higher than desired. When encountered, these thermal stresses may eventually lead to stress cracking in regions of high stress concentration.

Therefore, there exists a need for an improved steam manifold and distribution system capable of uniformly distributing steam through a plurality of steam distribution lines which does not experience high thermal stressing in use.

SUMMARY OF THE INVENTION

According to the present invention, there is provided a manifold for dividing a single, two-phase mixed stream of vapor and liquid into a plurality of individual streams of substantially uniform quality. The manifold comprises: a flow disperser having an inlet port for receiving the vapor-liquid mixture and at least two outlet ports; at least two hollow runners, each runner having a first end in fluid communication with one of the outlet ports of the flow disperser and a second end; a substantially toroidal manifold shell having at least two fluid receiver ports in fluid communication with each of the second ends of the runners, the manifold shell defining a manifold chamber; and a plurality of distribution ports spaced about the toroidal manifold shell, the distribution ports located on the toroidal manifold shell in a substantially coplanar relationship with the fluid receiver ports, each distribution port in fluid communication with the manifold chamber of the toroidal manifold shell; wherein the vapor-liquid mixture emanating from each the distribution port of the manifold is of substantially uniform quality.

A method for dividing a two-phase mixed stream of vapor and liquid into a plurality of individual streams of substantially uniform quality is also provided. The method comprises the steps of: feeding a two-phase mixed stream of vapor and liquid into a generally toroidally configured steam distribution manifold, the steam distribution manifold including: (i) a flow disperser having an inlet port for receiving the vapor-liquid mixture and at least two outlet ports; (ii) at least two hollow runners, each runner having a first end in fluid communication with one of the outlet ports of the flow disperser and a second end; (iii) a substantially toroidal manifold shell having at least two fluid receiver ports in fluid communication with each of the second ends of the runners, the manifold shell defining a manifold chamber; and (iv) a plurality of distribution ports spaced about the toroidal manifold shell, the distribution ports located on the toroidal manifold shell in a substantially coplanar relationship with the fluid receiver ports, each distribution port in fluid communication with the manifold chamber of the toroidal manifold shell; and distributing the two-phase mixed stream of vapor and liquid from the distribution ports of the steam distribution manifold to a plurality of injector sites.

Therefore, it is an object of the present invention to provide a manifold for dividing a single, two-phase mixed stream of vapor and liquid into a plurality of individual streams having substantially uniform vapor-to-liquid ratios.

Another object of the present invention resides in the provision of a manifold for distributing uniform quality wet steam from a single trunk line to multiple steam injector sites which is effective in an oil field environment.

Yet another object of the present invention is to provide a manifold for dividing a single vapor-liquid mixture stream into a plurality of individual streams of substantially uniform quality which is of simple configuration and easy to fabricate.

Still another object of the present invention is the provision of a manifold for distributing uniform quality wet steam from a single trunk line to multiple steam injector sites which is easy to operate and requires little maintenance.

It is a further object of the present invention to provide a method for uniformly dividing a single vapor-liquid mixture stream into a plurality of individual streams of substantially uniform quality.

It is still a further object of the present invention to provide a manifold for dividing a single vapor-liquid mixture stream into a plurality of individual streams of substantially uniform quality which is does not exhibit high thermal stressing in operation.

Other objects and the several advantages of the present invention will become apparent to those skilled in the art upon a reading of the specification and the claims appended thereto.

DETAILED DESCRIPTION OF THE PRESENT INVENTION

Figure 1:
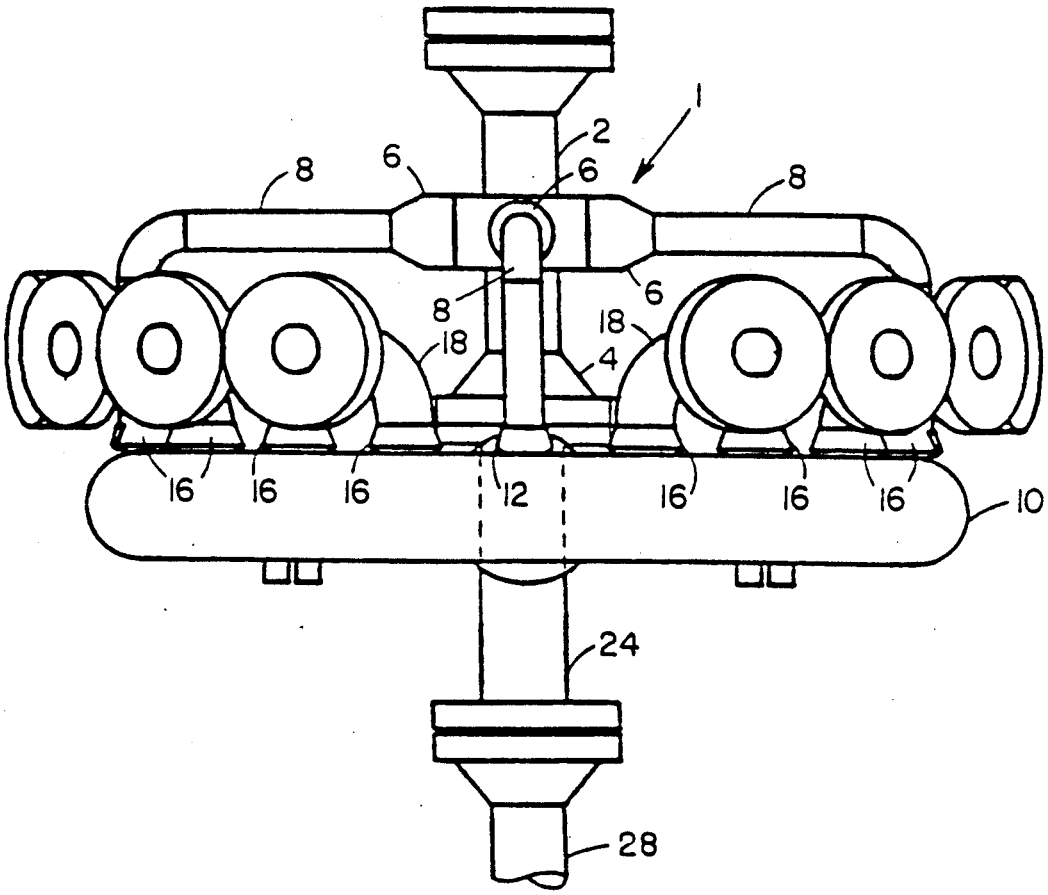
FIG. 1 is a side elevational view of a steam distribution manifold in accordance with the present invention.
Figure 4:
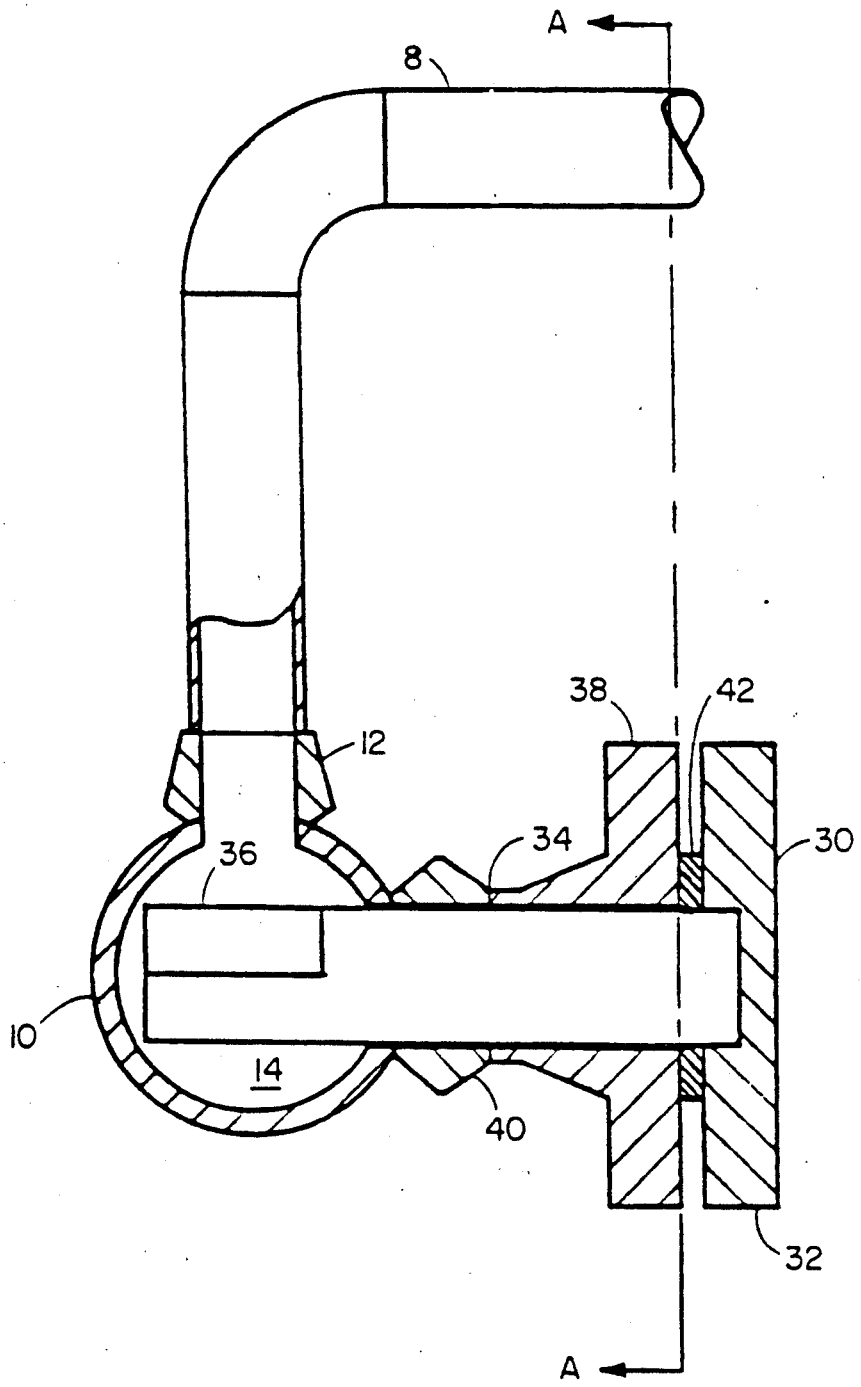
FIG. 4 is an enlarged fragmentary side view of the steam distribution manifold of FIG. 1, in partial cross-section.

The present invention is best understood by reference to the appended figures, which are given by way of example and not of limitation. Referring now to FIG. 1, a side elevational view of steam distribution manifold 1, is shown. In operation, wet steam is fed through trunk line 28 to centrally located steam inlet port 4 of steam distribution manifold 1 where it travels to flow disperser 2 for horizontal diversion to a plurality of outlet ports 6, progressing then to hollow runners 8. Hollow runners 8, as shown in FIG. 4, are in fluid communication with fluid receiver ports 12 of toroidal manifold shell 10. As can be envisioned by reference to FIG. 4, the interior surface of toroidal manifold shell 10 defines manifold chamber 14. Referring again to FIG. 1, the vapor-liquid mixture is drawn from manifold chamber 14 in response to various field injector requirements through a plurality of distribution ports 16. As is preferred, distribution ports 16 can be advantageously located on the upper peripheral surface of toroidal manifold shell 10, with fluid receiver ports 12 also located on the upper peripheral surface of toroidal manifold shell 10 in a substantially coplanar relationship, in order to minimize the thermal stressing which could otherwise result from having such stresses imparted in a plurality of planes and/or directions. The vapor-liquid mixture then passes through distribution legs 18 to individual injection wells (not shown). It is preferred that distribution ports 16 each have the same diameter, with the flow from each leg 18 to individual wells controlled by metering valves (not shown).

Optionally, steam distribution manifold 1 can employ a static mixer 24, preferably located directly below steam inlet port 4. Such a mixer, as those skilled in the art recognize, is designed to thoroughly distribute the liquid of the vapor-liquid mixture throughout the fluid. An example of such a mixer is the Komax® Triple Action Motionless Mixer, marketed by Komax Systems, Inc. of Long Beach, CA.

Figure 2:
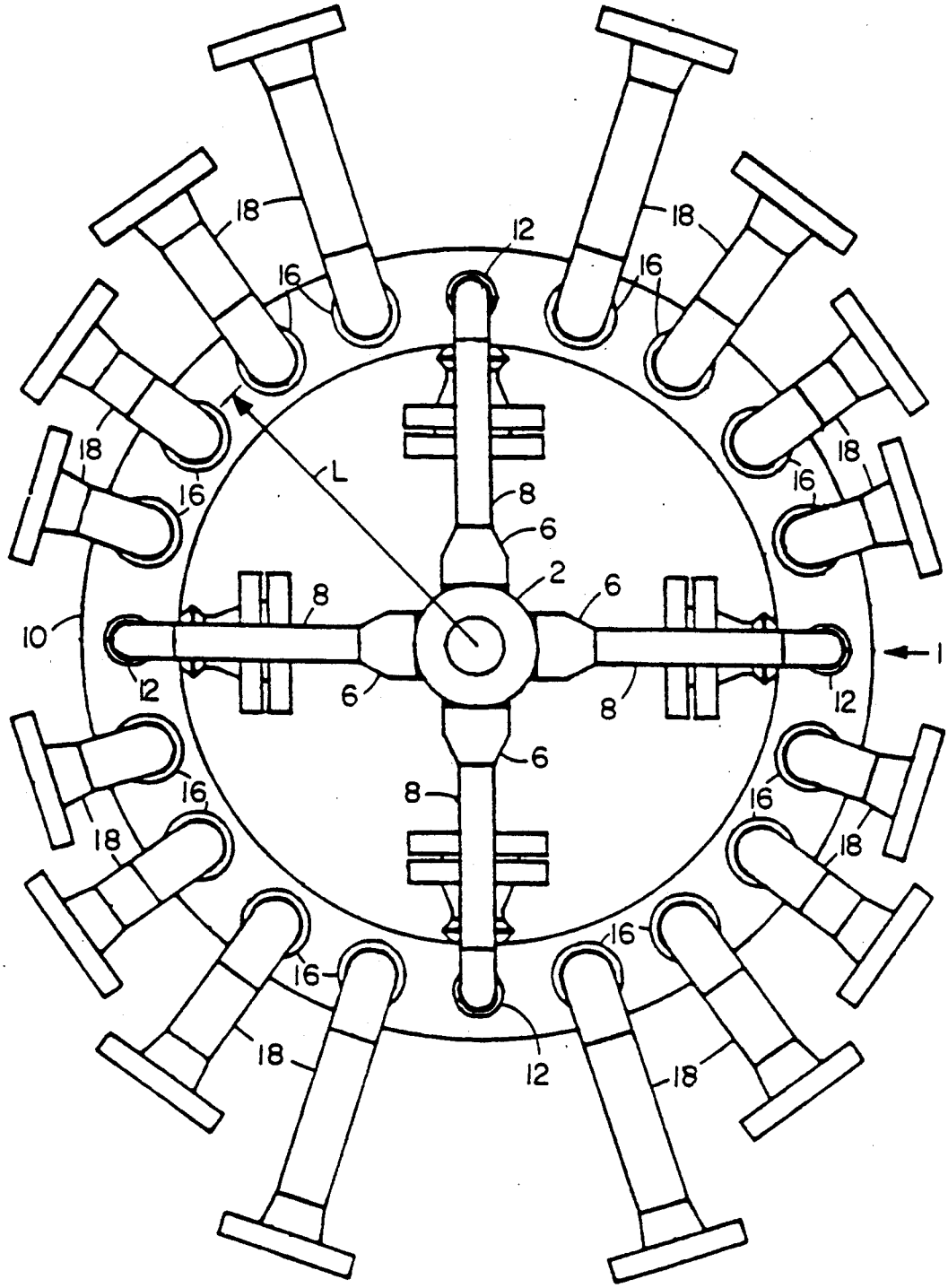
FIG. 2 is a top plan view of the steam distribution manifold of FIG. 1.

Referring now to FIG. 2, a top plan view of steam distribution manifold 1 is presented. As can be seen, flow disperser 2 diverts the vapor-liquid feedstream horizontally through outlet ports 6 to hollow runners 8 which are in fluid communication with fluid receiver ports 12 of toroidal manifold shell 10. To achieve uniform flow and distribution of the vapor-liquid mixture, it is preferred that at least two runners 8 be employed to feed the vapor-liquid stream into manifold chamber 14 of toroidal manifold shell 10; with three or four runners 8, spaced uniformly, as shown, still more preferred. It is also preferred that distribution ports 16 be spaced uniformly about the sectors of the toroidal manifold shell 10. The term sector refers to that portion of the toroidal manifold shell 10 defined by radial lines through any two adjacent fluid receiver ports 12. Since it is preferred in the practice of the present invention that distribution ports 16 be located in a substantially coplanar relationship with fluid receiver ports 12 in order to reduce thermal stresses within the manifold, the manifold depicted in FIG. 2 does not employ uniform distribution port 16 spacing about the circumference of toroidal manifold shell 10; but rather employs uniform spacing within each sector.

Referring still to FIG. 2, by providing toroidal manifold shell 10 with a relatively tight radius L excellent mixing of the vapor-liquid fluid is achieved. The degree of turbulence provided aids in the prevention of flow conditions which could cause separation or stratification of the vapor-liquid mixture. Such a configuration also improves the flow response to changes in steam injector line feed demands.

Figure 3:
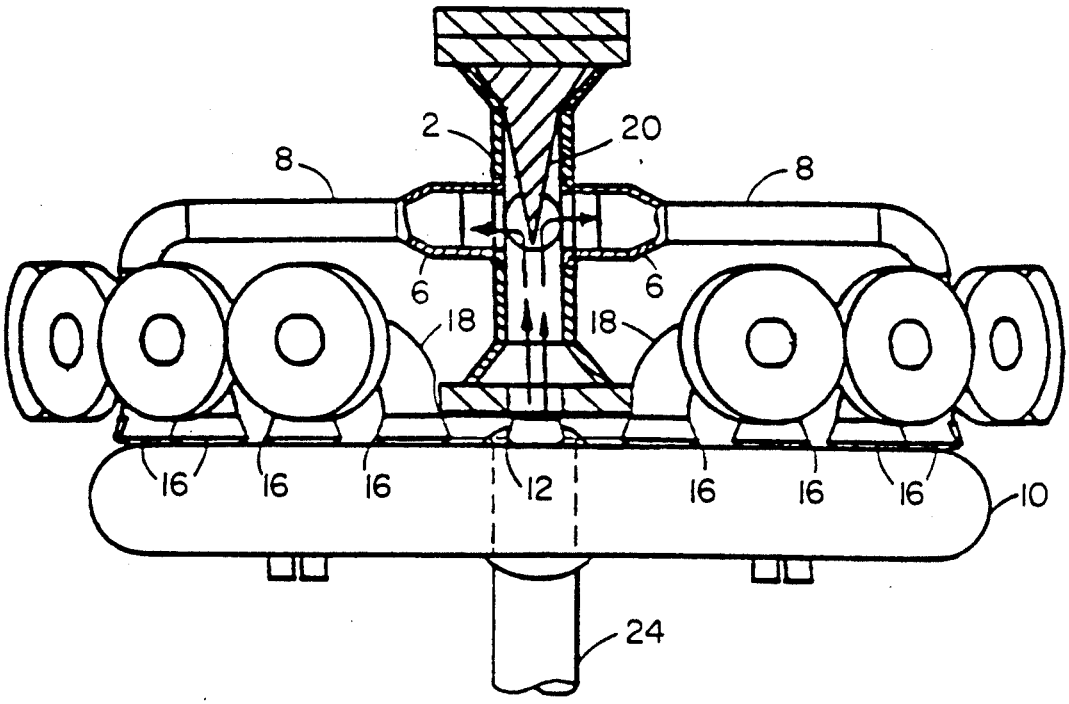
FIG. 3 is a side elevational view of the steam distribution manifold of FIG. 1, in partial cross-section.

Referring now to FIG. 3, a side elevational view of the steam distribution manifold is shown in partial cross-section. As can be envisioned, wet steam, mixed and channeled, will flow up to steam inlet port 4 where it then travels to flow disperser 2 for horizontal diversion to outlet ports 6 and runners 8. Shown within flow disperser 2 is dispersing member 20. Dispersing member 20 serves to divide the flow evenly among the runners 8 without inducing excessive amounts of turbulence to the flow stream. As is preferred, diverting member 20 can be a substantially conical structure, although structures having other configurations may have utility in this application. As can be appreciated, a diverting member of generally conical shape could be fabricated from sheet metal stock to have flat sides, for example three or more. To enable runners 8 to exhibit substantially equal pressure drops across their respective lengths, it was found that the flow rate of the vapor-liquid mixture through each runner 8 must exceed that found within the manifold chamber 14 of toroidal manifold shell 10. To achieve this phenomena, it was found necessary to obtain a Reynolds number 20% higher than that of trunk line 28 (see FIG. 1). The high resulting pressure drop allows for the uniform flow of the vapor-liquid mixture about manifold chamber 14 of toroidal manifold shell 10, even at the points where the mixture is being withdrawn from manifold 1 for downstream field use. The increased velocity also insures that the mixture travels about manifold chamber 14 of toroidal manifold shell 10 in a mist flow pattern, a pattern most ideal for maintaining even quality within manifold 1.

Referring now to FIG. 4 an enlarged fragmentary side view of steam distribution manifold 1 is shown in partial cross-section. As is preferred in the practice of the present invention, in order to uniformly distribute the two-phase mixture to each distribution port 16 (not shown), it is advantageous to employ manifold chamber diverting assembly 30 to facilitate flow within manifold chamber 14. As may be envisioned, manifold chamber diverting assembly 30 is advantageously located directly in the flow path of established by hollow runners 8 and fluid receiver ports 12 of toroidal manifold shell 10. Manifold chamber diverting assembly 30 is itself comprised of diverting member 34 having means for facilitating flow diversion 36. Diverting member 34 is affixed to plate 32 which enables the assembly 30 to be flange-mounted to manifold flange 38. To provide proper sealing gasket 42 is employed between the mating faces of manifold flange 38 and plate 32. Manifold flange 38 is welded to manifold boss 40, consistent with well-known practices. As can be appreciated, the number of manifold chamber diverting assemblies 30 may advantageously be selected to correspond to the number of hollow runners 8 and fluid receiver ports 12 employed, as is preferred.

Figure 6:
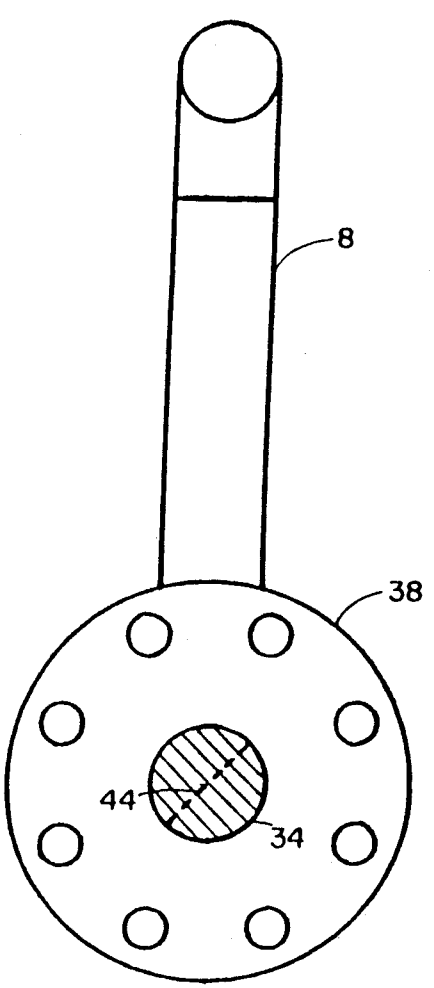
FIG. 6 is an enlarged fragmentary view taken along line A-A of FIG. 4 showing another form of manifold chamber inlet flow diverter, in accordance with the present invention.
Figure 5:
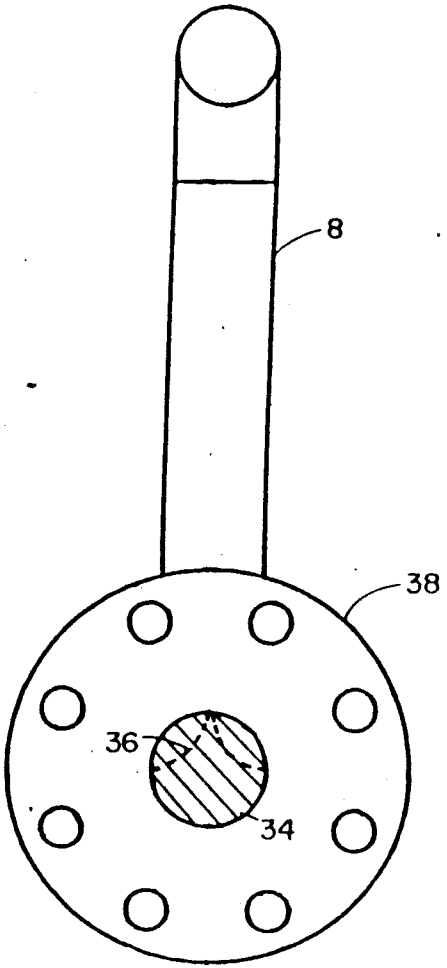
FIG. 5 is an enlarged fragmentary view taken along line A-A of FIG. 4 showing one form of manifold chamber inlet flow diverter, in accordance with the present invention.

Referring now to FIG. 5, an enlarged fragmentary view taken along line A-A of FIG. 4 is presented to show the cross-sectional shape of the means for facilitating flow diversion 36. As can be appreciated, the substantially triangular form of flow diversion means 36 serves to divide and disperse the downwardly impinging flow in two directions toward the centers of the adjacent sectors of the toroidal manifold shell 10. FIG. 6 presents an enlarged fragmentary view taken along line A-A of FIG. 4 depicting an alternate flow diversion means 44. As may be envisioned, the ramp-like form of flow diversion means 44 serves to direct the downwardly impinging flow in a counterclockwise pattern about toroidal manifold shell 10. It is within the scope of the present invention to employ a ramp-like form for flow diversion means 44 which would divert flow in a clockwise direction, as the benefit to be achieved would be substantially the same, regardless of direction.

The invention is further illustrated by the following non-limiting example.

EXAMPLE

A steam distribution manifold was built in accordance with the present invention, substantially as shown in the appended FIGS. 1–5. The manifold was designed to distribute uniform quality wet steam to 16 steam injector lines employed in a particular oil field from a 4" diameter steam trunk line. Toroidal manifold shell 10 was fabricated from 6" diameter steel tubing and provided with a radius L of approximately 2' Flow disperser 2 was constructed from a 4" schedule 80 cross and fitted with a substantially conical diverting member 20. Four 4"×2" concentric reducers were installed on flow disperser 2, to serve as outlet ports 6. Runners 8 were fabricated using 2" diameter schedule 160 pipe. Such dimensioning provided the requisite pressure drop to achieve uniform flow. Fluid receiver ports 12 were constructed using 6"×2" concentric reducers and located on the toroidal manifold shell 10 in a substantially coplanar relationship with the distribution ports 16. All 16 steam injector lines had diameters of 3". The manifold was installed and found to uniformly distribute the vapor-liquid wet steam mixture, with minimal variance in vapor-to-liquid ratio observed. Additionally, low thermal stresses were experienced due to the fact that fluid receiver ports 12 and distribution ports 16 were located on the toroidal manifold shell 10 in a substantially coplanar relationship with each other.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A method for distributing a two-phase mixed stream of vapor and liquid of substantially uniform quality to multiple injector sites, comprising the steps of:

(a) feeding a two-phase mixed stream of vapor and liquid into a generally toroidally configured steam distribution manifold, the steam distribution manifold including:

(i) a flow disperser having an inlet port for receiving the vapor-liquid mixture and at least two output ports;

(ii) at least two hollow runners, each runner having a first end in fluid communication with one of the outlet ports of the flow disperser and a second end;

(iii) a substantially toroidal manifold shell having at least two fluid receiver ports in fluid communication with each of the second ends of the runners, the manifold shell defining a manifold chamber; and (iv) a plurality of distribution ports spaced about the toroidal manifold shell, said distribution ports located on the toroidal manifold shell in a substantially coplanar relationship with the fluid receiver ports, each distribution port in fluid communication with the manifold chamber of the toroidal manifold shell; and (b) distributing the two-phase mixed stream of vapor and liquid from the distribution ports of the steam distribution manifold to a plurality of injector sites.

2. The method of claim 1, wherein the steam distribution manifold further includes a manifold chamber diverting assembly comprised of a diverting member having means for facilitating flow diversion.

3. The method of claim 2, wherein the flow disperser further includes a substantially conical diverting member.

4. The method of claim 3, wherein the diverting member axially aligned with the inlet port of the flow disperser.

5. The method of claim 4, wherein the flow disperser includes at least four outlet ports.

6. The method of claim 3, wherein the flow disperser includes at least four outlet ports.

7. The method of claim 2, wherein the flow disperser includes at least four outlet ports.

8. The method of claim 7, wherein the outlet ports of the flow disperser are perpendicularly aligned with the inlet port of the flow disperser.

9. The method of claim 2, wherein the outlet ports of the flow disperser are perpendicularly aligned with the inlet port of the flow disperser.

10. The method of claim 1, wherein the steam distribution manifold further includes a static mixer located below said inlet port of said flow disperser.

11. A manifold for dividing a single, two-phase mixed stream of vapor and liquid into a plurality of individual streams of substantially uniform quality, comprising:

(a) a flow disperser having an inlet port for receiving the vapor-liquid mixture and at least two outlet ports;

(b) at least two hollow runners, each runner having a first end in fluid communication with one of said outlet ports of said flow disperser and a second end;

(c) a substantially toroidal manifold shell having at least two fluid receiver ports in fluid communication with each of said second ends of said runners, said manifold shell defining a manifold chamber; and (d) a plurality of distribution ports spaced about said toroidal manifold shell, said distribution ports located on said toroidal manifold shell in a substantially coplanar relationship with said fluid receiver ports, each distribution port in fluid communication with said manifold chamber of said toroidal manifold shell;

wherein the vapor-liquid mixture emanating from each said distribution port of the manifold is of substantially uniform quality.

12. The manifold of claim 11, wherein said flow disperser includes a substantially conical diverting member.

13. The manifold of claim 12, wherein said diverting member is axially aligned with said inlet port of said flow disperser.

14. The manifold of claim 13, wherein said flow disperser includes at least four outlet ports.

15. The manifold of claim 12, wherein said flow disperser includes at least four outlet ports.

16. The manifold of claim 11, wherein said flow disperser includes at least four outlet ports.

17. The manifold of claim 16, wherein said outlet ports of said flow disperser are perpendicularly aligned with said inlet port of said flow disperser.

18. The manifold of claim 11, wherein said outlet ports of said flow disperser are perpendicularly aligned with said inlet port of said flow disperser.

19. The manifold of claim 11, further comprising a manifold chamber diverting assembly comprised of a diverting member having means for facilitating flow diversion.

20. The manifold of claim 11, further comprising a static mixer located below said inlet port of said flow disperser.

* * * * *